United States Patent [19]

Clarke et al.

[11] 4,269,051

[45] May 26, 1981

[54] ROLLING MILLS AND OPERATION THEREOF

[75] Inventors: Robin Clarke, Sheffield; Douglas J. Thomas, Poole; George T. F. Kilmister, Christchurch; Robert R. Beal, North Anston, Nr. Sheffield, all of England

[73] Assignee: Loewy Robertson Engineering Co. Ltd., Poole, England

[21] Appl. No.: 26,186

[22] Filed: Apr. 2, 1979

[30] Foreign Application Priority Data

Mar. 31, 1978 [GB] United Kingdom ..... 12668/78

[51] Int. Cl.[3] ..... B21B 37/00

[52] U.S. Cl. ..... 72/9; 72/17

[58] Field of Search ..... 72/8–11, 72/16, 17

[56] References Cited

U.S. PATENT DOCUMENTS

| | | | |
|---|---|---|---|
| 3,499,306 | 3/1970 | Pearson | 72/17 |
| 3,731,508 | 5/1973 | Sabatini et al. | 72/9 |

FOREIGN PATENT DOCUMENTS

| | | | |
|---|---|---|---|
| 1539597 | 1/1979 | United Kingdom | 72/17 |

*Primary Examiner*—Milton S. Mehr

*Attorney, Agent, or Firm*—Schwartz & Weinrieb

[57] ABSTRACT

To operate a rolling mill to roll metal strip with a satisfactory degree of flatness, signals from tension detecting means located downstream of the mill rolls are used continuously to determine the best symmetrical parabola which fits the shape of the strip and a parameter of the parabola is used to bring about an adjustment of the bending of the mill rolls in such a sense as to change the parameter substantially to zero. Signals from the detecting means may be used in addition to control the steer of the mill and adjust the temperature of the roll assemblies along their length.

11 Claims, 5 Drawing Figures

ROLLING MILLS AND OPERATION THEREOF

FIELD OF THE INVENTION

This invention relates to the rolling of metal strip and to methods of operating a rolling mill to roll metal strip.

BACKGROUND OF THE INVENTION

During rolling of metal strip, if the strip is to achieve a satisfactory degree of flatness, it is necessary to match the roll gap to the profile of the incoming strip in such a way that the relative reduction at all zones across the strip width is constant. If a mis-match occurs, then this will lead to a local variation in reduction which in turn will produce longer or shorter elements in the strip. During rolling, flatness errors may be concealed because the strip is stretched elastically. The flatness of the strip is directly related to the tension distribution across the width of the strip and hence, by detecting this tension distribution during the rolling process, an indication of the flatness quality of the strip being rolled can be obtained.

A mill operator has three adjustments which be can use to bring about improved flatness in strip being rolled. These adjustments are-bending control of the mill rolls, steer control and roll temperature control. At rolling speeds which are common at the present time, it is difficult for an operator to use these various controls manually in order to produce strip material with an acceptable flatness and quality.

SUMMARY OF THE INVENTION

According to a first aspect of the present invention, in a method of operating a rolling mill to roll metal strip, said mill having a pair of roll assemblies, means for bending the roll assemblies and detecting means located downstream of the roll assemblies to detect the tension of the strip being rolled at a plurality of zones positioned across the width thereof, wherein signals from said detecting means are used substantially continuously to determine the best symmetrical parabola (as herein after defined) which fits the shape of the strip being rolled as represented by the signals and a parameter of the parabola is used to bring about an adjustment of the roll bending in such a sense as to change that parameter substantially to a predetermined value.

Conveniently the mill has means for adjusting the gap between the roll assemblies differentially between their ends and signals from said detecting means are used substantially continuously to determine the best straight line (as herein after defined) which fits the shape of the strip being rolled as represented by the signals and a parameter of the line is used to bring about differential adjustment of the roll gap in such a sense as to change that parameter substantially to a predetermined value.

In addition to the roll bending means and the roll gap adjusting means, the mill may have means for adjusting the temperature of the roll assemblies along their length, and high and low values in the variation of the tension of the strip across its width may be evened out by localised adjustment of the temperature of the roll assemblies along their length.

According to a second aspect of the present invention, in a method of operating a rolling mill to roll metal strip, the mill having a pair of roll assemblies, means for adjusting the temperature of the roll assemblies along their length and detecting means located downstream of the roll assemblies to detect the tension of strip being rolled at a plurality of zones positioned across the width thereof, the output signals from the detecting means are modified substantially continuously to have a zero mean value and then compared with upper and lower threshold values, the results of said comparisons controlling the adjustment of the temperature of the roll assemblies along their length.

The detecting means located downstream of the roll assemblies to detect the tension of the strip being rolled at a plurality of zones positioned across the width thereof may be a shapemeter sold under the trade mark VIDIMON by Loewy Robertson Engineering Company Limited.

A steer action on a rolling mill is one in which movable rolls in a stack are tilted relative to fixed rolls so as to cause a linear variation of reduction across the strip width.

The basic effects of positive roll bending are to increase the reduction at the centre of the strip and to reduce the reduction at the edges of the strip. Conversely, negative work roll bending gives increased reduction at the edges of the strip and can lead to a decrease in the reduction at the centre of the strip.

For control purposes, the effects of heat input to the rolls can be grouped under two headings:

1. Symmetrical crown effects.
2. Local disturbances.

In use, greater thermal expansion normally takes place in the central region of the rolls than occurs at the outer regions and a symmetrical thermal crown is developed. Local flatness errors occur for a variety of reasons during rolling. These errors can be corrected by local adjustment of the temperature of the rolls so as to change the roll radius where the error occurs. It is usual for the rolls to be cooled by coolant sprayed on to the rolls but it is possible for heat to be added to the rolls to provide a localised temperature adjustment.

BRIEF DESCRIPTION OF THE DRAWINGS

In order that the invention may be more readily understood it will be described, by way of example only, with reference to the accompanying drawings, in which.

DETAILED DESCRIPTION OF THE ILLUSTRATED EMBODIMENTS

Figure 1:
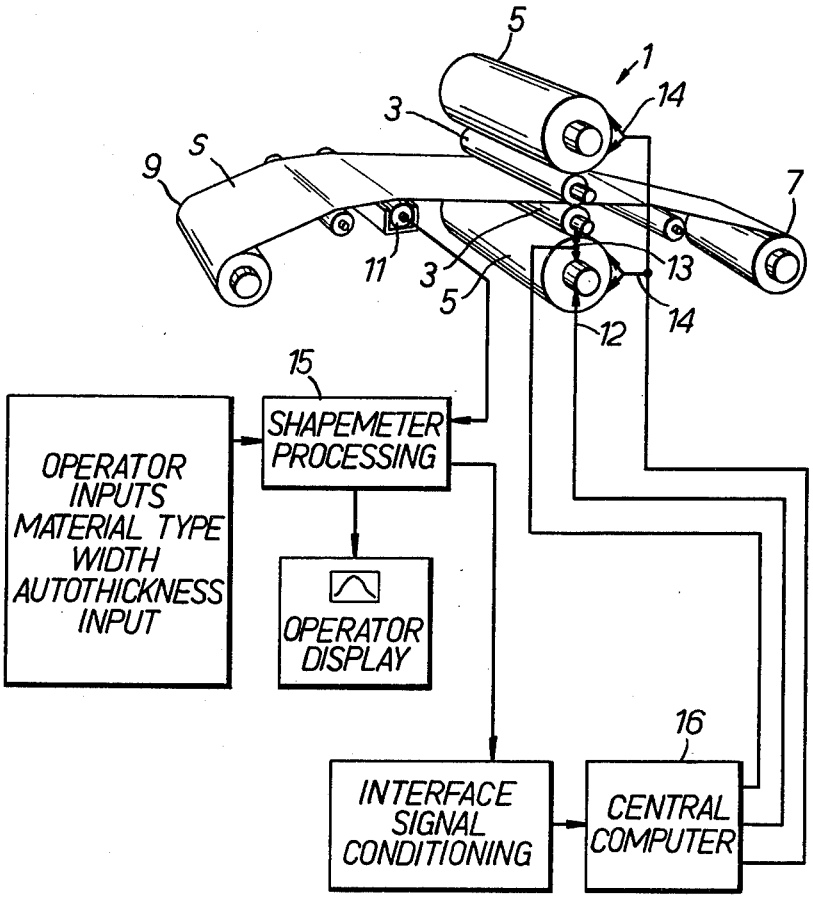
FIG. 1 shows diagrammatically a flatness control system in accordance with one embodiment of the invention.

Referring to FIG. 1, a rolling mill 1 has a pair of work rolls 3 each backed up by a back-up roll 5. Strip S being rolled passes through the gap between the work rolls from an uncoiler 7 to a coiler 9. Between the rolling mill and the coiler 9 there is positioned a tension detecting means in the form of a VIDIMON shapemeter 11 against which the underside of the strip is pressed and the shapemeter indicates the tension in a plurality of zones spaced apart across the width of the strip. The mill has means 12 for adjusting the gap between the work rolls at opposite ends thereof so that the steer of the material passing through the mill can be adjusted. In addition, the rolling mill is provided with roll bending means 13 by which both positive and negative roll bending can be applied to the work rolls. Positioned adjacent to and along the length of the work and back-up rolls, a plurality of individually controllable sprays 14 are positioned so that coolant can be directed from the sprays on to localised zones of the work and back-up rolls.

Electrical signals representative of the tension in the rolled strip at various zones across its width are fed from the shapemeter 11 into a shapemeter processing apparatus 15. Into this apparatus various operator inputs concerning the type of material, the width and other predetermined information, can be fed. From the apparatus signals are applied to computing means 16 and outputs from the computing means can be used to adjust the roll bending, the steer and the temperature variation of the rolls, respectively.

The automatic steer control system is based on the results of empirical tests on the mill. Ideally the tests should be carried out on the mill to be controlled but it may be acceptable to use the results from another similar mill. The tests are carried out whilst the mill is rolling under normal operating conditions and a record is taken of the tension distribution across the width of the strip from the shapemeter. The steer is then changed to a different value and a new record is taken when equilibrium has again been established. These two measured shape profiles can then be subtracted (on a point by point basis) and the resulting difference divided by the change in the value of steer, to give the "per unit" shape profile change arising from the steer change. This is repeated over the full operating range of widths, thicknesses, materials and speeds which are used on the mill.

Suppose for given rolling conditions the experiment finds a shape change $F_n$ per unit steer change. $F_n$ specifies the tension change on the $n^{th}$ shapemeter channel, and there will be a set of N numbers $F_n$ (corresponding to all the shapemeter channels covered by the strip) which define the shape profile change across the strip width. Then, for a steer change of x, the shape change will be $xF_n$ (assuming linearity). Under normal rolling conditions, if the measured shape resembles $xF_n$, then it will be possible to largely correct it by steer action; but if the shape profile is completely dissimilar from $xF_n$, then steer will be no help. It therefore follows that it is necessary to pick out that component of the measured shape which has the same form as $xF_n$.

The steer control strategy is therefore to find that straight line of the form $xF_n+k$ which most nearly fits the current shape profile $S_n$. The constant k represents the standing tension level of the strip; it is necessary to include it in the equation to get the best fit to $S_n$, but it is of no interest for shape control (which is only concerned with tension differences across the strip). The criterion normally used in choosing the best fitting line is to minimise the sum of the squares of the errors, that is, $\epsilon E_n^2$, where $E_n=xF_n+k-S_n$. The values of the variables x and k have to be computed to achieve this minimisation. The mathematics of this process leads to the result $x=\epsilon W_n S_n$, where $W_n$ are a set of "weighing factors". In other words x is a linear sum of the measured shape values $S_n$, each value $S_n$ being multiplied by a corresponding weighting factor $W_n$. It should be noted that the weighting factors $W_n$ may be schedule-dependent, that is different sets of $W_n$ may have to be used for different widths, thicknesses, materials or speeds.

The computed value of x represents the parameter of the best fitting straight line of the form $F_n$. It can therefore be regarded as the component of the measured shape $S_n$ which is correctable by steer action. After finding the best straight line through the measured shape profile the parameter x would be the height of the right-hand end of the line relative to the left-hand end. However, it is also possible for the curve $F_n$ to be slightly S-shaped; the important point is that the shape used for curve-fitting should be the same as that derived from the empirical tests. The term best straight line is defined as "best fitting curve of the form $F_n$ derived from the empirical tests".

Normally the target is for flat shape, that is, for $X=o$. However, in some cases it may be desirable to aim for a "tilted" profile, for example, if there is a temperature gradient across the strip, or if there are mechanical alignment errors of the mill, shapemeter or coiler. It is therefore prudent to provide the mill operator with a "tilt" control (for example, a calibrated potentiometer) which specifies the desired value of x ($x_D$ say); this will have a central zero (for flat shape), with $x_D$ being negative and positive on either side so as to enable the operator to tilt the shape profile in either direction.

The on-line steer control system therefore takes the measured shape profile $S_n$ and computes $x=\epsilon W_n S_n$. (The number of terms in this summation depends on the strip width, that is, on the number of shapemeter channels covered by the strip). It then subtracts the desired signal $x_D$ (from the operator's tilt control) to give the error $e=x-x_D$. The signal e can then be used to control the steer via a suitable controller. However, in order to achieve stability of the closed-loop feedback system, with an adequate response time, the "gain" has to be set correctly. The optimum value of gain depends on rolling parameters such as width, thickness, material and speed. The error e is therefore multiplied by a schedule-dependent gain factor. It then feeds a controller whose output controls the steer. The controller parameters have to be set to give an acceptable system transient response, and are dependent on the time response of the mill-strip-shapemeter combination to a steer action (which was preferably recorded during the empirical tests).

The automatic bending control system is also based on the results of empirical tests on the mill. The bending tests are carried out in a very similar manner to the steer case, and they enable the shape change $F_n$ per unit change in roll bending force to be derived. The resulting curve $F_n$ will, of course, be dependent on rolling conditions (width, thickness, and the like).

In practice the curve $F_n$ is a symmetrical parabola (that is, a curve of the form $ax^2+c$, where x is the distance from the strip centre line), although sometimes $F_n$ can have a flatter central portion than a parabola does. The term symmetrical parabola is defined as "a curve of the form $F_n$ derived from the empirical tests".

The basic strategy for bending control is identical to that for steer control. The aim is to find that curve of the form $F_n+k$ which best fits the shape $S_n$, and again the mathematical result is $x=\epsilon W_n S_n$. The only difference to the steer case is that the weighting factors $W_n$ will have different numerical values (and again they will be schedule-dependent). In the bending case x represents the amplitude of the best-fitting parabola (in the generalised sense defined above) to the currently measured shape profile. x will be positive, for example, if the curve is convex upwards, zero if the curve is flat (that is, has no parabolic component), and negative if it is concave upwards.

As with steer it may sometimes be desirable to aim for non-flat strip from the mill, for example if the centre of the strip is hotter than the edges, or if slack edges are required to minimise edge cracking and strip breakage. The operator may therefore be provided with a "bow" control which sets the desired value of x ($x_D$), which will be calibrated from concave upwards through a central zero (flat) position to convex upwards.

Again the error $e=x-x_D$ is fed through a schedule-dependent gain change into a controller (e.g. proportional—plus—integral), the output of which feeds the pressure control system for balance (and possibly contrabalance). As with steer the controller output may either be added to the operator's manual bending control, or alternatively a switch may be used to select the controller or the manual signal.

The rolling process generates heat which increases the roll temperature, and coolant is normally applied to the rolls to counteract this effect. When the coolant is applied in a non-uniform manner along the length of the rolls, then a non-uniform change to the roll gap can be created. This in turn causes a shape change in the rolled strip. Automatic roll coolant control exploits this effect by changing the coolant distribution in accordance with the measured shape error so as to aim for good shape. It is therefore a feedback control system.

The cooling system is divided into a number of zones along the length of the rolls, with individual control of each zone. There are several possible forms of controls:

(a) simple on/off control of the coolant (b) several switched levels of coolant flow, for example 0, 1, 2 or 3 units; or (c) continuously variable coolant flow. However, whichever method of coolant control is used, the automatic roll coolant system selects just two levels of flow (that is high flow and low flow), and switches from low to high and vice versa at appropriate instants of time. In many cases the low flow level would be zero flow (that is the spray completely off in that zone), but this would not necessarily be always the case. Both low and high flow levels could be arranged to depend on the material thickness, width, composition, and the like, (except of course for case (a) above); however, once selected according to the schedule information at the start of the coil, these levels would remain unchanged throughout the coil. But each individual spray zone is liable to switch many times between high and low throughout the length of the coil.

In most cases both work roll sprays and back-up roll sprays would be controlled, although it is possible to control the sprays on one roll only and to leave the other roll sprays constant (or even subject to operator control). Likewise the top roll sprays and the bottom roll sprays would normally be ganged together, but again this could be varied if desired. The flows available on the individual rolls are not necessarily equal, but for each separate roll a low and high flow level would be selected. However, in all cases the controlled sprays in each vertical zone would be switched simultaneously, that is, all high or all low.

The spacing of the spray zones is preferably related to the spacing of the shapemeter channels in a simple ratio, for example, 1:1 or 1:2 or 1:3. However this is not essential, and if an awkward ratio exists then an interpolation technique must be used on the shapemeter information; this is an extra complication, but it does not affect basic philosophy. If the ratio is 1:1, that is if each spray zone coincides with the corresponding shapemeter channel, then there are effectively N virtually-independent control systems, with each shapemeter signal controlling the corresponding spray zone. If there are 2 or 3 spray zones per shapemeter channel, then one possibility is to switch all those zones simultaneously, thus ganging them together. An alternative strategy is to use a simple interpolation on the shapemeter signals, to give a smoother cooling effect, (that is a finer resolution across the strip width). To simplify the description a 1:1 matching is assumed from this point onwards.

Normally the spray zones outside the edges of the strip are completely switched off, and are not therefore subject to automatic control. It would, however, be possible to put some coolant in this area if it were considered desirable; this could be a constant flow, or it could (for example) be ganged to the outermost controlled sprays.

Figure 2:
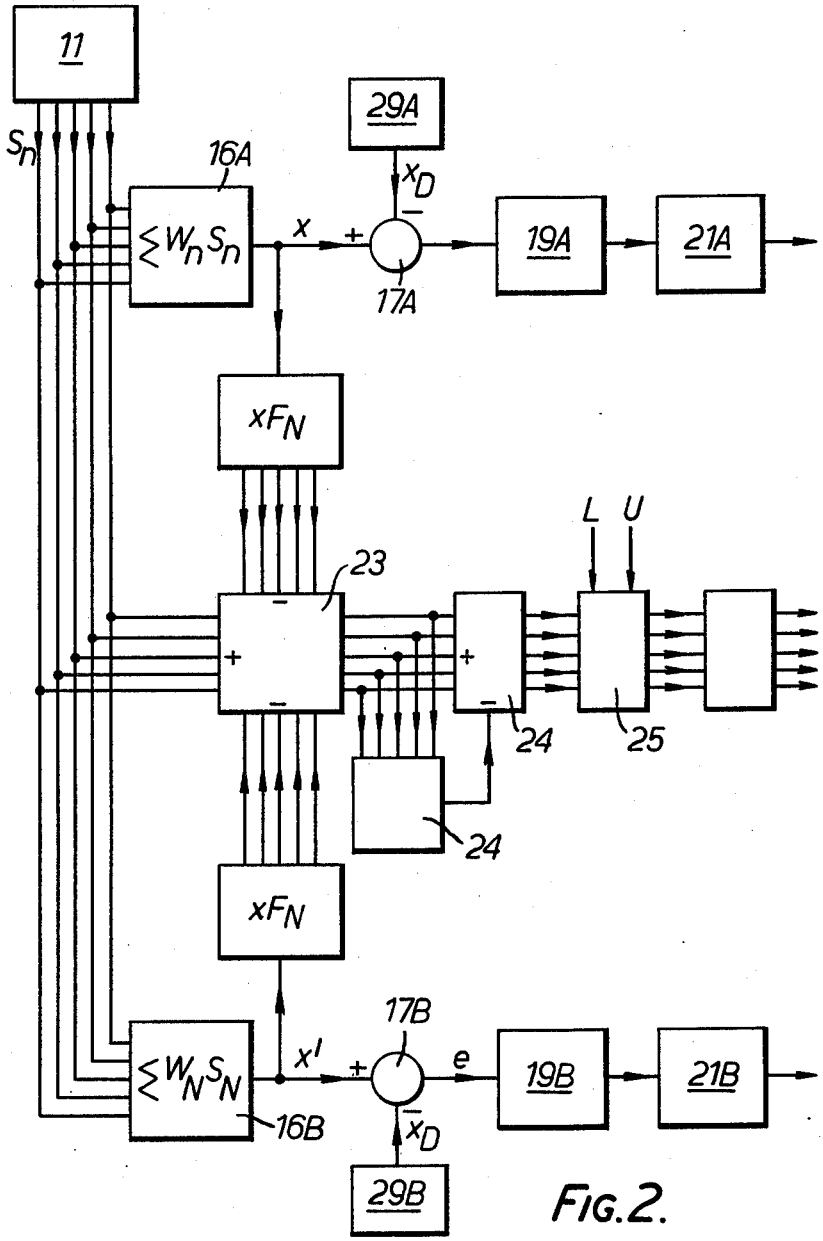
FIG. 2 is a block circuit diagram of the control system shown in FIG. 1.

Referring to FIG. 2, a shapemeter 11 has for example five channels and the outputs from the channels are fed to two sections 16A and 16B of the computing means 16. In 16A the computation $x=\epsilon W_n S_n$ is made and signal x is fed to a subtract device 17A from which the operator's tilt control $x_D$ from controller 29A is subtracted to leave an error e. This is supplied to a gain multiplier 19A and the output is fed to a controller 21A. The controller 21A controls the mill steer. In parallel with this circuitry an output from 16B is of the form $x=\epsilon W_n S_n$. This signal is fed to a substract device 17B from which a signal $x_D$ fed in by the operator from controller 29B is subtracted to give an error signal $e=x-x_D$. The error signal is fed through a gain multiplier 19B and to a controller 21B from which it is used to control the roll bending.

The signals from the shapemeter 11 are also supplied to a subtract device 23 in which the outputs x from the computing devices 16A and 16B are subtracted. Of the outputs from the subtract device 23 an average calculation is made in circuitry 24 and the average value is subtracted from each of the values on the outputs of the device 23 to give a zero mean value. These outputs are then compared in a comparison device 25 with two threshold levels L and H and the outputs then comprise high and low signals for operating the spray zones.

Figure 3:
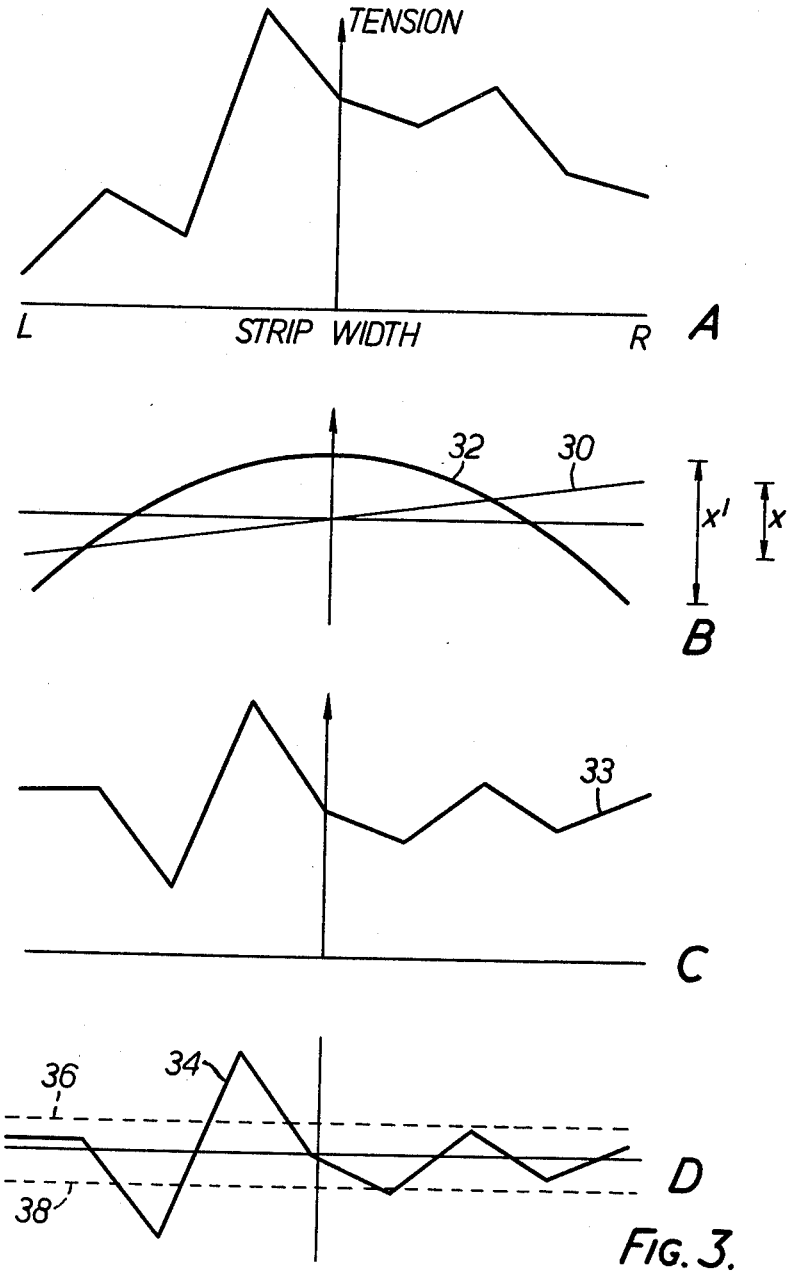
FIG. 3 illustrates how the measured shape profile is manipulated in accordance with the block diagram of FIG. 2, and FIGS. 4 and 5 show alternatives to part of the circuit shown in FIG. 2.

In FIG. 3A, a strip profile as measured by a nine channel shapemeter 11 is indicated. It will be seen that the tension at the right-hand edge is greater than that at the left-hand edge and the computing device 16A prepares a best fitting straight line on a point by point basis across the strip width. The line is indicated by reference numeral 30 in FIG. 3B. Similarly the computing means 16B computes the best fitting symmetrical parabola and this is indicated by reference numeral 32. FIG. 3C shows the residual strip profile 33 after the straight line 30 and the parabola 32 have been subtracted on a point by point basis by the subtract device 23. After subtracting the average calculation from the output of subtract device 23, the wave-form is as shown by reference numeral 34 in FIG. 3D. It can be seen that over a greater part of the width of the strip the curve is within the upper and lower threshold levels 36 and 38. It is arranged that the spray zones are such that, when the height of the curve is below the level 38, the coolant flow to the spray zone is high. Between the lower and upper levels 38, 36, the coolant flow to the spray zone is unchanged from what it has been, and above the level 36 the coolant flow to the spray zone is low.

As described earlier, the steer control computes the amplitude (x) of the best fitting straight line (in the generalised sense defined previously) from the shapemeter signals. If x is multiplied by the empirically-determined shape change per unit steer change ($F_n$) giving the numbers $xF_n$, we get the exact form of this best-fitting line on a point by point basis across the strip width. Similarly the form of the best-fitting parabola (in the generalised sense) can be computed by multiplying the bending amplitude x by the bending $F_n$ values. (N.B. The additive constants k defined earlier, which are needed to get the best fit between the line or parabola and the shape profile, are ignored at this stage. They merely shift the curve vertically, but are irrelevant as far as the form or amplitude are concerned).

The next step is to subtract the best-fitting straight line and the best-fitting parabola from the measured shape curve (on a point by point basis across the strip width). The resulting curve 33 will therefore have zero linear component and zero parabolic component, and is therefore completely incapable of correction by steer or bending. It is this curve which is used for coolant control.

The average height of this curve is next calculated (based on all the shapemeter channels which are covered by the strip). This average represents the average tension across the strip width, and is of no interest for shape control. The average value is therefore subtracted from each individual point of the curve, which shifts the curve bodily downwards and results in a curve 34 with zero mean level. Hence some points on the curve will now be positive and some will be negative.

The points on this curve are next compared with two threshold levels, a lower level 38 and an upper level 36. Normally the upper level will be positive and the lower level will be negative, but this need not necessarily be true, and it is even possible for the two levels to be equal. The levels can also be schedule-dependent, according to width, thickness, speed, and the like.

It follows that the gap between the lower and upper levels represents a hysteresis band. If the level of the curve is rising the sprays will switch to LOW at the upper level, and if the level is falling the sprays will switch to HIGH at the lower level.

The calculations and decision-making processes described above are repeated regularly at short time intervals, the intervals being small compared with the response time of the mill to the control actions. The calculations could even be performed on a fully continuous basis.

If there are any random fluctuations of the signals from the shapemeter (for example due to electrical noise pick-up, or other system imperfections), then the above strategy could sometimes lead to a very rapid switching of the sprays (especially if the upper and lower levels are close, or even equal). This could cause a severe rate of wear on the control valves. To prevent this a "prohibition" time is imposed on each zone. Whenever a zone has switched its state (in either direction), any further switching of that zone is inhibited until the prohibition time has elapsed.

In some cases a bending force beyond one end or the other of the maximum range may be needed to give good shape, in which case the automatic bending control will be unable to eliminate the parabolic shape error, and will merely drive the bending force to the appropriate limit.

Under these circumstances it is logical to allow the coolant control system to assist with correcting the parabolic shape error. The system described above subtracts the best-fitting parabola from the shapemeter signals before feeding the coolant control system. If one omits to subtract this parabola, then the coolent control will attempt to remove the parabolic component. However, if the coolant control is to correct for parabolic error, it must also be responsive to the operator's bow control 30. A method of achieving this is shown in FIG. 4.

When the logic-controlled switch 31 is in the normal position the system operates in the standard manner, that is, the best-fitting parabola is subtracted. But when the switch is in the "C" position, $x_D$ replaces x, and the multiplier creates the desired parabolic shape profile as specified by the bow control. This desired parabola is then subtracted from the shapemeter signals, and the resulting error signals feed the coolant control; the latter therefore attempts to correct the parabolic error.

Clearly the switch must be in the "N" position in middle region of the bending force range, and in the "C" position at each end. It is, however, desirable to be able to use the "C" position when approaching (but before actually reaching) the end of the range, so that the coolant control can do some useful correction before the bending control reaches its limit. But a difficulty occurs here, since the bending control is still operational and is therefore maintaining x approximately equal to $x_D$; if momentarily the bending system has over-corrected, then the cooling system would operate in the wrong direction. To overcome this problem the switch logic control must be dependent on the sign of the bending error (e); if bending has undercorrected the switch will go to "C", enabling the coolant control to assist, and if bending has over-corrected, then the switch will revert to "N".

Figure 4:
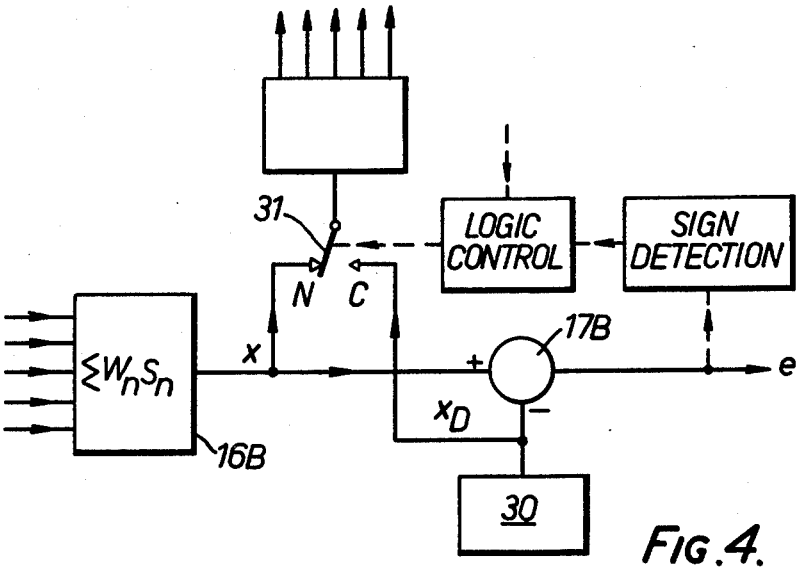
Figure 5:
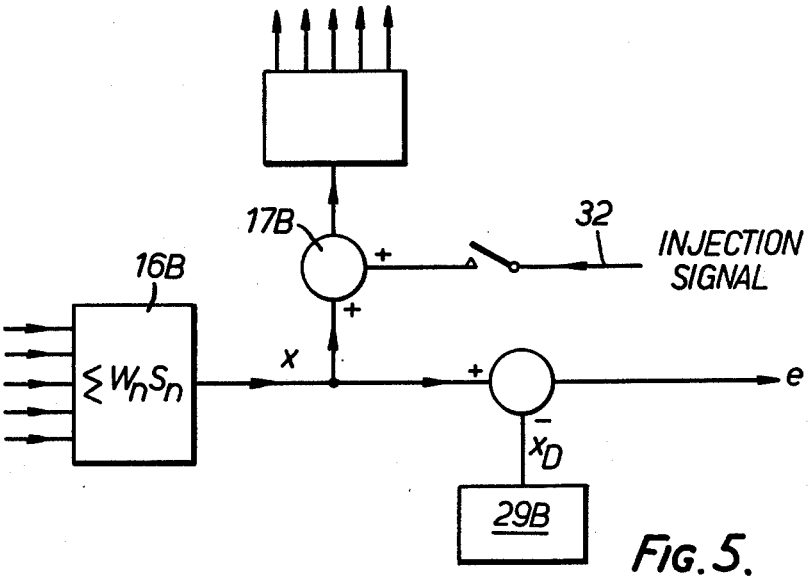

An alternative method of making the coolant control assist the bending control when near to (but not quite at) the end of the range is shown in FIG. 5; this can be used either instead of, or in addition to the method of FIG. 4. When the injection signal 32 is switched on (near the end of the range) it will feed an additive signal to the multiplier, which will cause a parabolic shape (in the appropriate sense) to be superimposed on the shapemeter signals feeding the coolant control. This will force the coolant control to try and create a thermal crown in such a direction as to assist the bending control (that is, to bring the bending force back towards the middle of the range). The injection signal could be a constant signal switched in near the end of the bending range. Alternatively it could increase progressively as the end of the range is approached.

The coolant control system as described above can sometimes result in most (or possibly even all) of the sprays being simultaneously in the LOW flow state, or simultaneously in the HIGH flow state, for a short period of time. This means that the total coolant flow to the mill can vary over a wide range, which is undesirable. Moreover the roll coolant also acts as a lubricant in the roll gap, and if most of the sprays are turned off simultaneously the lack of lubrication can interfere with the rolling process.

However, it can be seen from FIG. 3D that if the upper and lower threshold levels are raised (either jointly or individually), then the number of sprays in the HIGH flow state will tend to increase, thus increasing the total coolant flow. Conversely, lowering the threshold levels will tend to reduce the coolant flow. It is therefore possible to exercise some control over the total coolant flow by dynamically varying the threshold levels as rolling proceeds.

Various strategies are possible for this control. One possibility is to impose upper and lower limits to the total coolant flow, and to adjust the threshold levels if the limits are exceeded in such a way as to restore the flow to within those limits. Another possibility is to aim for some specific level of total coolant flow (for example, 50% of maximum,), and to adjust the threshold levels until this flow is achieved. (However this last approach may not necessarily give the best shape control).

In some cases it may be more appropriate to heat the rolls, instead of cooling them. This is especially true of mills where the rolling process generates very little heat, for example, temper or skin-pass mills. Various forms of heating are possible, such as hot fluid jets, induction heating, and the like. The precise form of heating used is immaterial, as long as it is subdivided into a number of individually controlled zones along the length of the rolls.

The strategy described above for coolant control is equally applicable to heating control. The only difference is that HIGH cooling must be replaced by LOW heating, and LOW cooling must be replaced by HIGH heating. Thus the heating is switched between the LOW and HIGH states as rolling proceeds.

The control of the roll bending apparatus above provides a considerable improvement to the flatness of the strip being rolled. The steer control added to the roll bending control provides a further improvement and maximum improvement is obtained when roll bending, steer and temperature controls are used together. Roll bending and temperature controls together may be used.

When the strip is very thin, that is in the form of foil, a significant improvement in the flatness of the foil being rolled results if the temperature control above is used.

Obviously, many modifications and variations of the present invention are possible in light of the foregoing teachings. It is therefore to be understood that within the scope of the appended claims, the present invention may be practiced otherwise than as specifically described herein.

We claim:

1. A method of operating a rolling mill, for rolling metal strip, which includes a pair of roll assemblies, means for adjusting the gap between said roll assemblies at each of their ends, means for bending said roll assemblies, means for adjusting the temperature of said roll assemblies along their length, and means located downstream of said roll assemblies for detecting the tension of a strip being rolled at a plurality of zones defined across the width thereof, comprising the steps of:

utilizing signals from said detecting means to substantially continuously determine the best straight line which fits the shape of said strip being rolled as represented by said signals;

utilizing at least one parameter of said straight line to initiate differential adjustment of said roll gap in such a sense as to change said parameter substantially to a predetermined value;

utilizing said signals from said detecting means to substantially continuously determine the best symmetrical parabola which fits the shape of said strip being rolled as represented by said signals;

utilizing at least one parameter of said parabola to initiate the operation of said roll bending means in such a sense as to change said parameter substantially to a predetermined value;

estimating the resulting effect of said differential adjustment and said roll bending action upon said signals from said detecting means; and subtracting said estimated effects from said signals from said detecting means so as to produce residual signals which are used to operate said temperature adjusting means in order to adjust the temperature of said roll assemblies at localized regions along their length so as to even out residual variations of said tension of said strip across its width.

2. A method of operating a rolling mill, for rolling metal strip, which includes a pair of roll assemblies, means for adjusting the gap between said roll assemblies at each of their ends, means for bending said roll assemblies, means for adjusting the temperature of said roll assemblies along their length, and means located downstream of said roll assemblies for detecting the tension of a strip being rolled at a plurality of zones defined across the width thereof, comprising the steps of:

utilizing signals from said detecting means to substantially continuously determine the best straight line which fits the shape of said strip being rolled as represented by said signals;

utilizing at least one parameter of said straight line to initiate differential adjustment of said roll gap in such a sense as to change said parameter substantially to a predetermined value;

estimating the resulting effect of said differential adjustment upon said signals from said detecting means;

subtracting said estimated effect from said signals from said detecting means so as to produce residual signals;

utilizing said residual signals to substantially continuously determine the best symmetrical parabola which fits the shape of said strip being rolled as represented by said residual signals;

utilizing at least one parameter of said parabola to initiate an adjustment of said roll bending means in such a sense as to change said parameter substantially to a predetermined value;

estimating the resulting effect of said roll bending action upon said residual signals; and subtracting said estimated effect from said residual signals so as to produce further residual signals which are used to operate said temperature adjusting means in order to adjust the temperature of said roll assemblies at localized regions along their length so as to even out residual variations of said tension of said strip across its width.

3. A method of operating a rolling mill as set forth in claim 1, further comprising the steps of:

modifying said residual signals so as to have a zero mean value; and comparing said modified signals with upper and lower threshold values, the resulting signal values controlling the operation of said temperature adjusting means.

4. A method of operating a rolling mill as set forth in claim 2, further comprising the steps of:

modifying said further residual signals so as to have a zero mean value; and comparing said modified signals with upper and lower threshold values, the resulting signal values controlling the operation of said temperature adjusting means.

5. A method of operating a rolling mill as claimed in claim 1 or 2, wherein the parameter of the parabola is the difference between the amplitude of the parabola at its centre and at its ends and said predetermined value is zero.

6. A method of operating a rolling mill as claimed in claim 1 or 2, wherein the parameter of the straight line is the difference between the vertical amplitude of the line at opposite ends of the strip and said predetermined value is zero.

7. A method of operating a rolling mill as claimed in claim 1 or 2, wherein when the amount of roll bending applied to the rolls is outside a predetermined range of values, modified signals are applied to the means for adjusting the temperature of the roll assemblies to modify the overall thermal crown of the roll assemblies in such a sense as to assist the effect of the roll bending means and to thereby tend to return the amount of roll bending applied to the rolls to within said predetermined range of values.

8. A method of operating a rolling mill as claimed in claims 1 or 2, wherein the means for adjusting the temperature of the roll assemblies comprise individually controllable jets of fluid coolant.

9. A method of operating a rolling mill as claimed in claims 1 or 2, wherein the means for adjusting the temperature of the roll assemblies comprise individually controllable zones of heating.

10. A method of operating a rolling mill as claimed in claim 8, wherein the controllable jets are operated such that the total quantity of fluid coolant applied to the roll assemblies remains within a predetermined range of values.

11. A method of operating a rolling mill as claimed in claim 1 or 2, wherein the means for adjusting the temperature of the roll assemblies comprise individually controllable jets of fluid coolant and the total quantity of fluid coolant applied to the roll assemblies is kept within a predetermined range of values by raising or lowering said threshold values.

* * * * *